US009158229B2

(12) United States Patent
Ohashi et al.

(10) Patent No.: US 9,158,229 B2
(45) Date of Patent: Oct. 13, 2015

(54) DEVELOPMENT DEVICE AND IMAGE FORMING APPARATUS INCLUDING THE SAME

(71) Applicant: KYOCERA DOCUMENT SOLUTIONS INC., Osaka (JP)

(72) Inventors: Hiroaki Ohashi, Osaka (JP); Masahiro Kashimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/155,213

(22) Filed: Jan. 14, 2014

(65) Prior Publication Data

US 2014/0205310 A1 Jul. 24, 2014

(30) Foreign Application Priority Data

Jan. 21, 2013 (JP) ..... 2013-008460

(51) Int. Cl.
*G03G 15/08* (2006.01)

(52) U.S. Cl.
CPC ..... *G03G 15/0812* (2013.01); *G03G 15/0815* (2013.01); *G03G 15/0877* (2013.01)

(58) Field of Classification Search
CPC ..... G03G 15/095; G03G 15/0887
USPC ..... 198/533; 222/203
See application file for complete search history.

(56) References Cited

U.S. PATENT DOCUMENTS

| | | | | |
|---|---|---|---|---|
| 8,494,400 | B2 | 7/2013 | Kashimoto et al. | |
| 2011/0229184 | A1* | 9/2011 | Kashimoto et al. | 399/92 |
| 2012/0201575 | A1 | 8/2012 | Kashimoto et al. | |

FOREIGN PATENT DOCUMENTS

| | | | |
|---|---|---|---|
| JP | 05330588 | A * | 12/1993 |
| JP | H10-221956 | A | 8/1998 |
| JP | 2007-003865 | A | 1/2007 |
| JP | 2011-197285 | A | 10/2011 |
| JP | 2012-208469 | A | 10/2012 |

OTHER PUBLICATIONS

An Office Action; "Notice of Reasons for Rejection," issued by the Japanese Patent Office on Apr. 21, 2015, which corresponds to Japanese Patent Application No. 2013-008460 and is related to U.S. Appl. No. 14/155,213.

* cited by examiner

*Primary Examiner* — Clayton E Laballe
*Assistant Examiner* — Leon W Rhodes, Jr.
(74) *Attorney, Agent, or Firm* — Studebaker & Brackett PC

(57) ABSTRACT

A development device includes a sheet member, a support member, and a vibration applying device. The sheet member is disposed between a developer carrier and a blade to receive a developer falling from the developer carrier toward the blade. The developer carrier is disposed to face to an image carrier on which an electrostatic latent image is formed and configured to supply the developer to the image carrier in a facing area to the image carrier. The blade is configured to regulate an amount of the developer carried on the developer carrier. The support member holds the sheet member. The vibration applying device applies vibration to the sheet member. The sheet member is stretchable and flexible and is stretched over the support member.

10 Claims, 7 Drawing Sheets

DEVELOPMENT DEVICE AND IMAGE FORMING APPARATUS INCLUDING THE SAME

INCORPORATION BY REFERENCE

This application is based on and claims the benefit of priority from Japanese Patent application No. 2013-008460 filed on Jan. 21, 2013, the entire contents of which are incorporated herein by reference.

BACKGROUND

The present disclosure relates to a development device configured to supply a developer to an image carrier and to an image forming apparatus including the same.

An electrophotographic image forming apparatus is configured to form an image through processes of forming an electrostatic latent image by irradiating a beam formed on the basis of image information to a circumferential surface of an image carrier (a photosensitive drum), of transferring a toner image formed by supplying a toner (a developer) to the electrostatic latent image from a development device on a sheet, and of carrying out a fixing process.

In recent years, with advances of color printing and high-speed processing, a configuration of the image forming apparatus is becoming sophisticated and rotational speed of a toner agitation member in the development device is being increased. According to this, a pressure within the development device becomes positive, i.e., higher than an atmospheric pressure. Due to that, the toner floats from an inside of the development device, is discharged out of an opening facing to the photosensitive drum, and contaminates an inside of an apparatus main body of the image forming apparatus. It has also become difficult to supply a required toner to the electrostatic latent image on the photosensitive drum.

In particular, in the development device, there is a case where the scattered toner accumulates around a blade regulating an amount of the developer to be carried on a developer carrier. If the accumulated toner coagulates and adheres on a developing roller, a fall of toner occurs, thereby causing an image defect.

In order to solve such a problem, there is a development device in which an elliptic roller is disposed in a concave part formed on a wall provided between an area where a developing roller faces to a photosensitive drum and an ear-breaking blade and in which a film member is attached so as to cover the concave portion by fixing an upper end part thereof and leaving a lower end part as a free end. In the development device, by rotating the elliptic roller, a convex part of the elliptic roller pushes up the film member to largely move the free end side of the film member. According to this, the toner is prevented from accumulating on the film member.

There is also a development device including a toner receiving member, a sheet member and a vibration motor. The toner receiving member has a wall part provided between an area where a developing roller faces to a photosensitive drum and an ear-breaking blade and is disposed in a substantially whole longitudinal area of the wall part to receive the toner falling from the developing toner. The sheet member is pasted on a surface of the toner receiving member. The vibration motor has an exciting weight attached to an output shaft in order to vibrate the toner receiving member. This development device prevents the toner from accumulating on the film member by rotationally driving the vibration motor to vibrate the toner receiving member.

However, in the former development device mentioned above, although the largely movable free end side prevents the toner from accumulating on the film member, there is a possibility that the barely movable fixed end side cannot sufficiently prevent the toner from accumulating on the film member.

Regarding this point, in the latter development device mentioned above, because the toner receiving member on which the film member is pasted vibrates by the drive of the vibration motor, the toner is prevented from accumulating on the film member. However, the latter development device mentioned above needs to be provided with a mechanism that permits fine movements of the vibration motor, wiring and the toner receiving member, and others within the development device. In the latter development device mentioned above, because the film member needs to be pasted on the toner receiving member, there are problems that it is inevitable to enlarge and complicate the development device and to increase costs and an assembly time.

SUMMARY

In accordance with one aspect of the present disclosure, a development device includes a sheet member, a support member, and a vibration applying device. The sheet member is disposed between a developer carrier and a blade to receive a developer falling from the developer carrier toward the blade. The developer carrier is disposed to face to an image carrier on which an electrostatic latent image is formed and configured to supply the developer to the image carrier in a facing area to the image carrier. The blade is configured to regulate an amount of the developer carried on the developer carrier. The support member holds the sheet member. The vibration applying device applies vibration to the sheet member. The sheet member is stretchable and flexible and is stretched over the support member.

In accordance with another aspect of the present disclosure, an image forming apparatus includes a development device. The development device includes a sheet member, a support member, and a vibration applying device. The sheet member is disposed between a developer carrier and a blade to receive a developer falling from the developer carrier toward the blade. The developer carrier is disposed to face to an image carrier on which an electrostatic latent image is formed and configured to supply the developer to the image carrier in a facing area to the image carrier. The blade is configured to regulate an amount of the developer carried on the developer carrier. The support member holds the sheet member. The vibration applying device applies vibration to the sheet member. The sheet member is stretchable and flexible and is stretched over the support member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, a color printer as an image forming apparatus according to an embodiment of the present disclosure will be described with reference to the appended drawings. It is noted that in the following description, front and rear, right and left, and upper and lower directions are set as shown by arrows in each drawing on the basis of directions shown by arrows in FIG. 1 for convenience.

Figure 1:
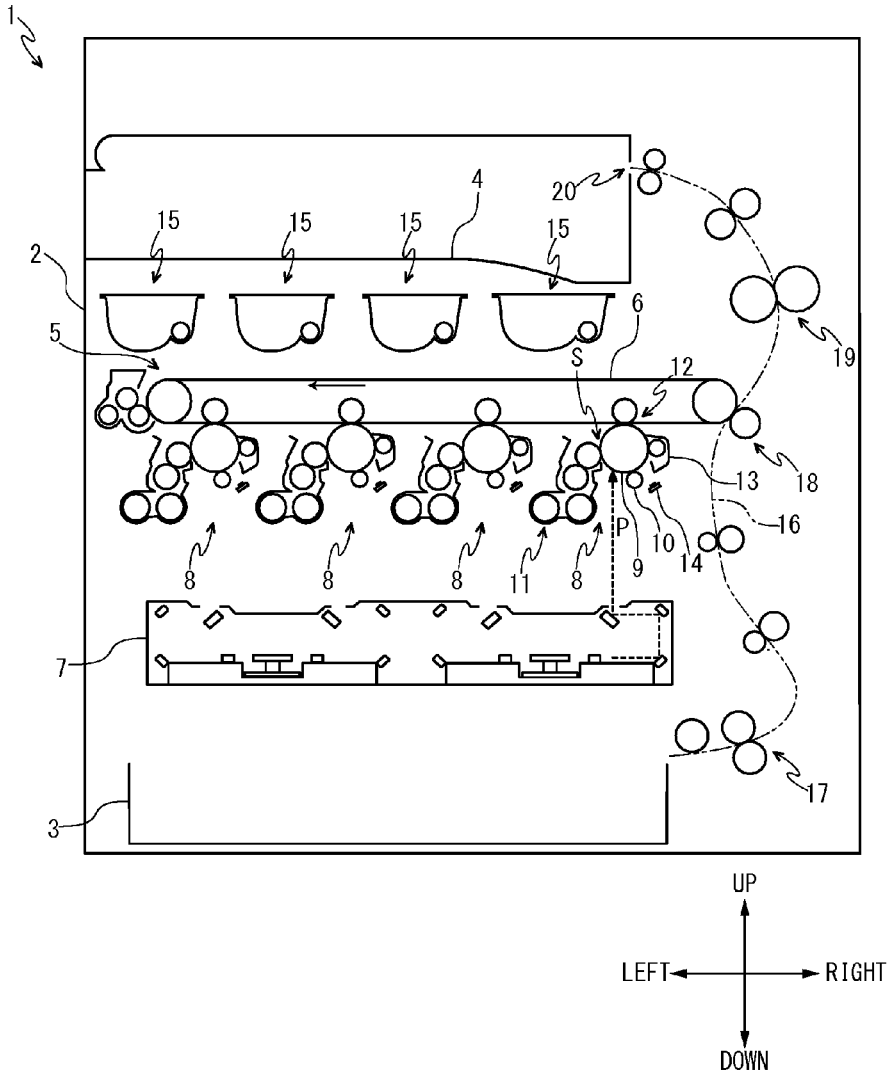
FIG. 1 is a sectional view schematically showing an internal structure of a color printer according to an embodiment of the present disclosure.

With reference to FIG. 1, the entire structure of the color printer 1 will be descried. FIG. 1 is a sectional view schematically showing the color printer 1 according to the embodiment of the present disclosure.

The color printer 1 includes a box-formed printer main body 2. In a lower part of the printer main body 2, a sheet feeding cartridge 3 configured to store sheets (not shown) is installed and, in an upper part of the printer main body 2, an ejected sheet tray 4 is installed.

In the upper part of the printer main body 2, an intermediate transferring unit 5 attachable to/detachable from the printer main body 2 is installed. The intermediate transferring unit 5 includes an intermediate transfer belt 6 provided around a plurality of rollers, and, below the intermediate transfer belt 6, an exposure device 7 composed of a laser scanning unit is disposed. At a center part of the printer main body 2, four image forming units 8 respectively corresponding to colors of toners (developers) are installed along a lower part of the intermediate transfer belt 6. It is noted that one out of the four image forming units 8 will be described below.

In the image forming unit 8, a photosensitive drum 9 is rotatably provided. Around the photosensitive drum 9, a charger 10, a development device 11, a first transferring unit 12, a cleaning device 13, and a static eliminator 14 are located in a process order of the first transferring. Above the development device 11, four toner containers 15 respectively corresponding to the image forming units 8 are provided for the colors (yellow, magenta, cyan, and black) of the toners. It is noted that a predetermined amount of a two-component developer in which the toner of each color is mixed with a carrier is filled in each development device 11. When a rate of the toner within the filled two-component developer falls below a specified value, the toner is replenished from the toner container 15 to the development device 11.

At one side (the right-hand side of FIG. 1) in the printer main body 2, a sheet conveying path 16 of the sheet is positioned. At an upstream end of the conveying path 16, a sheet feeder 17 is positioned. At an intermediate stream part of the conveying path 16, a second transferring unit 18 is positioned at one end of the intermediate transferring belt 6. In a downstream part of the conveying path 16, a fixing unit 19 attachable to/detachable from the printer main body 2 is positioned and, in a downstream end of the conveying path 16, an ejection opening 20 is positioned.

Next, the operation of forming an image by the color printer 1 having such a configuration will be described. When the power is supplied to the color printer 1, various parameters are initialized and initial determination, such as temperature determination of the fixing unit 19, is carried out. Subsequently, in the color printer 1, when image data is inputted and a printing start is directed from a computer or the like connected with the color printer 1, image forming operation is carried out as follows.

First, the surface of the photosensitive drum 9 is electrically charged by the charger 10. Then, exposure corresponding to the image data is carried out on the photosensitive drum 9 by a laser (refer to an arrow P) from the exposure device 7, thereby forming an electrostatic latent image on the surface of the photosensitive drum 9. The electrostatic latent image is developed to a toner image having a correspondent color with the toner in the development device 11. The toner image is first-transferred onto the surface of the intermediate transferring belt 6 in the first transferring unit 12. The above-mentioned operation is repeated in order by the image forming units 8, thereby forming the toner image having full color onto the intermediate transferring belt 6. Toner and electric charge remained on the photosensitive drum 9 are eliminated by the cleaning device 13 and static eliminator 14.

On the other hand, the sheet fed from the sheet feeding cartridge 3 or a manual bypass tray (not shown) by the sheet feeder 17 is conveyed to the second transferring unit 18 in a suitable timing for the above-mentioned image forming operation. Then, in the second transferring unit 18, the toner image having full color on the intermediate transferring belt 6 is second-transferred onto the sheet. The sheet with the second-transferred toner image is conveyed to a downstream on the conveying path 16 to enter the fixing unit 19, and then, the toner image is fixed on the sheet in the fixing unit 19. The sheet with the fixed toner image is ejected from the ejection opening 20 onto the ejected sheet tray 4.

Figure 2:
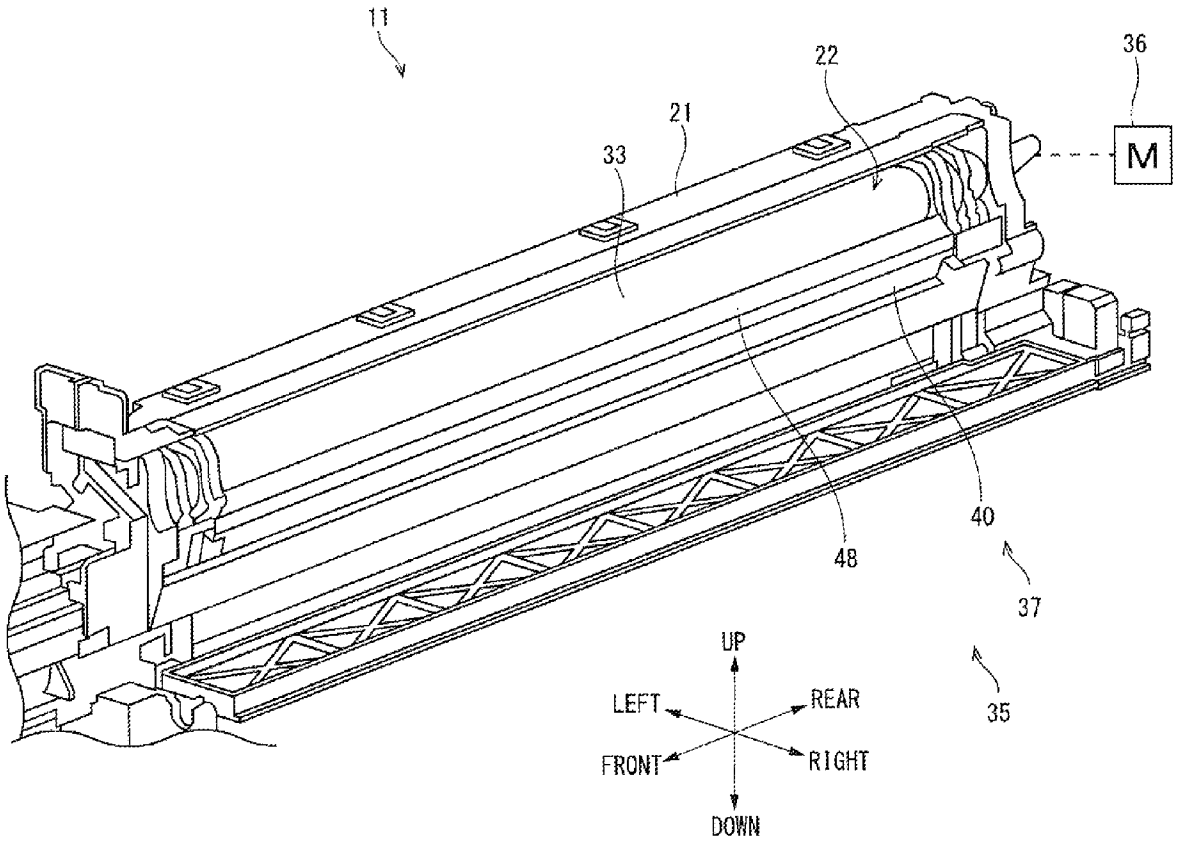
FIG. 2 is a perspective view showing a development device according to the embodiment of the present disclosure.
Figure 3:
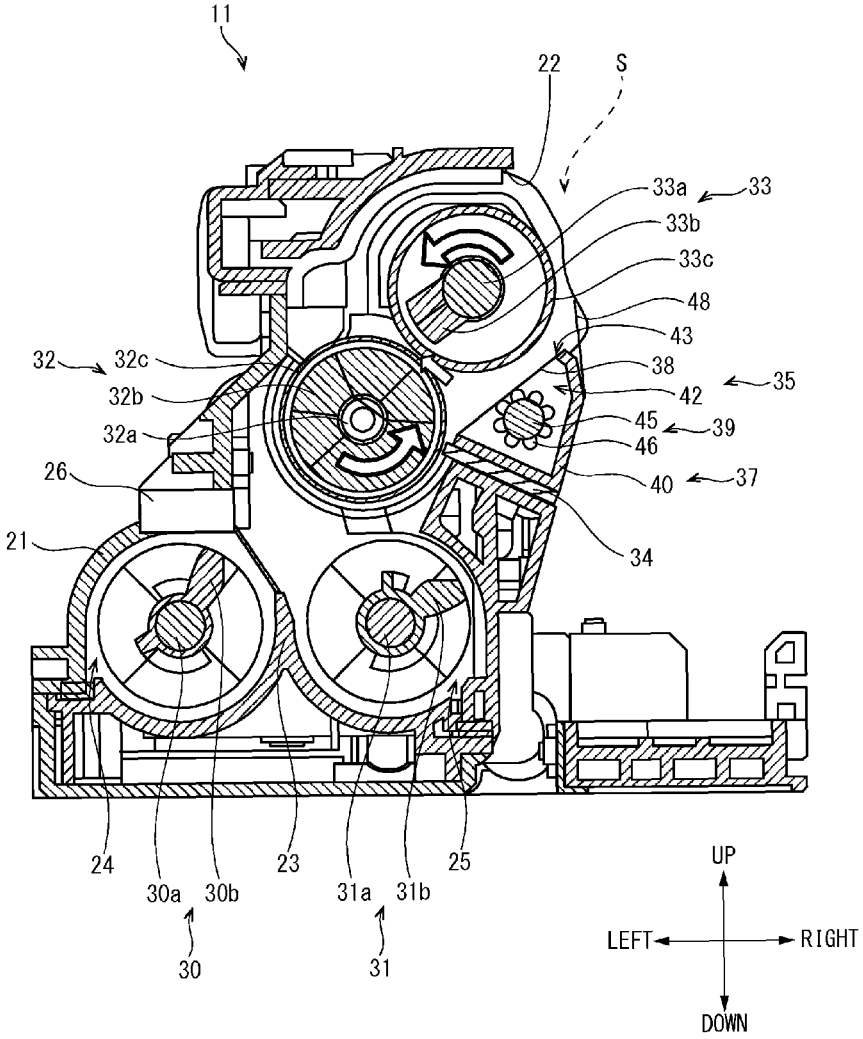
FIG. 3 is a sectional view showing an internal structure of the development device according to the embodiment of the present disclosure.

Next, the development device 11 will be described in detail with reference to FIGS. 2 and 3. FIG. 2 is a perspective view showing the development device 11 according to the present embodiment, and FIG. 3 is a sectional view showing an internal structure of the development device 11. It is noted that one out of the four development devices 11 will be illustrated in the following description.

As shown in FIGS. 2 and 3, an external appearance of the development device 11 is configured by a casing 21 in which a two-component developer (hereinafter, imply called as "developer") are housed. The casing 21 extends in an obliquely upper right direction in FIG. 3 and has an opening 22 formed at a right side face in its upper part. In a lower part of the casing 21, a partition wall 23 is vertically provided such that the partition wall 23 divides the lower part of the casing 21 into an agitation conveying chamber 24 and a supply conveying chamber 25.

The development device 11 includes an agitation conveying screw 30 disposed in the agitation conveying chamber 24, a supply conveying screw 31 disposed in the supply conveying chamber 25, a magnetic roller 32 disposed above the supply conveying screw 31, a developing roller 33 disposed so as to face to the magnetic roller 32 at an obliquely upper right side of the magnetic roller 32, an ear-breaking blade 34 disposed in proximity with a circumferential surface of the magnetic roller 32, and a toner receiving mechanism part 35 disposed between the developing roller 33 and ear-breaking blade 34. It is noted that the magnetic roller 32 and the developing roller 33 are concrete examples of the developer carrier.

The agitation conveying screw 30 and supply conveying screw 31 as an agitation member respectively include screw blades 30*b* and 31*b* fixed in a radial direction from circumferential surfaces of rotary shaft parts 30*a* and 31*a*. Both end parts in an axial direction (a direction vertical to a sheet surface in FIG. 3) of the rotary shaft parts 30*a* and 31*a* are rotatably pivoted by the casing 21. The agitation conveying screw 30 and supply conveying screw 31 rotate around the shafts in the agitation conveying chamber 24 and supply conveying chamber 25 to mix, to agitate and to electrify the toner (positively charged toner) supplied from the toner container 15 (see FIG. 1) with the carrier.

In the agitation conveying chamber 24, a toner density sensor (not shown) is disposed so as to face the agitation conveying screw 30, and, on the basis of a detected result of the toner density sensor, the toner is replenished from the toner container 15 to the agitation conveying chamber 24 through a toner replenishing port 26. It is noted that, as the toner density sensor, for example, a magnetic permeability sensor detecting magnetic permeability of the developer within the casing 21 is used.

The magnetic roller 32 is composed of a roller shaft part 32*a* unrotatably supported by the developing casing 21, a magnetic pole member 32*b* having a fan-like shape in section, and a nonmagnetic rotational sleeve 32*c* that includes the roller shaft part 32*a* and magnetic pole member 32*b*. Both end parts in the axial direction (the direction vertical to the sheet surface of FIG. 3) of the rotational sleeve 32*c* are rotatably pivoted to the developing casing 21, and the rotational sleeve 32*c* rotates in a counterclockwise direction in FIG. 3.

The magnetic roller 32 is connected to a developing bias power source through a bias control circuit (both not shown). To the magnetic roller 32, direct current voltage (hereinafter, called as "Vmag(DC)") and alternate current voltage (hereinafter, called as "Vmag(AC)") are applied from the developing bias power source.

The developing roller 33 is composed of a fixed shaft part 33*a* unrotatably supported to the developing casing 21, a developing magnetic pole member 33*b* provided at a position facing to the magnetic roller 32, and a developing sleeve 33*c* formed in a cylindrical shape by a nonmagnetic metallic material. The developing sleeve 33*c* is rotatably supported by the fixed shaft part 33*a* to rotate in the counterclockwise direction in FIG. 3. The developing magnetic pole member 33*b* composed of a magnet is fixed to the fixed shaft part 33*a* while leaving a predetermined space from the developing sleeve 33*c*. It is noted that the developing magnetic pole member 33*b* has a polarity opposite from a magnetic pole (main pole) of the magnetic pole member 32*b* to which the developing magnetic pole member 33*b* faces. The developing roller 33 is disposed so as to face to the magnetic roller 32 with a predetermined gap. A part of the developing roller 33 is exposed out of the opening 22 of the casing 21 and faces to the photosensitive drum 9 (see FIG. 1). It is noted that a facing area S in a vicinity of the opening 22 is a part where the developing roller 33 faces to the photosensitive drum 9.

The developing roller 33 is connected to the developing bias power source through the bias control circuit (both not shown). To the developing roller 33, direct current voltage (hereinafter, called as "Vslv(DC)") and alternate current voltage (hereinafter, called as "Vslv(AC)") are applied from the developing bias power source.

The ear-breaking blade 34 is mounted in a state slanting in a lower right direction between the casing 21 and toner receiving mechanism part 35 at an upstream side in a rotational direction of the magnetic roller 32 from a position where the developing roller 33 faces to the magnetic roller 32. A leading edge part of the ear-breaking blade 34 is disposed along an axial direction of the magnetic roller 32 in a state having a slight gap from a surface of the magnetic roller 32.

It is noted that the toner receiving mechanism part 35 will be described in detail later.

While not shown, gears are mounted to one axial ends (a rear end part in FIG. 2) of the agitation conveying screw 30 (the rotary shaft part 30*a*), supply conveying screw 31 (the rotary shaft part 31*a*), magnetic roller 32 (the rotational sleeve 32*c*) and developing roller 33 (the developing sleeve 33*c*), respectively. The respective gears are connected to a driving unit 36, such as a motor, through a first gear train (not shown). By rotationally driving the driving unit 36, the agitation conveying screw 30, supply conveying screw 31, magnetic roller 32, and developing roller 33 rotate in a body.

While also not shown, a rotary brush (with gear) dispersing the toner replenished through the toner replenishing port 26 is rotatably provided at another axial end (e.g. a front end part in FIG. 2) of the agitation conveying screw 30 (the rotary shaft part 30*a*). A driving force (a rotational force) of the driving unit 36 is firstly transmitted to the agitation conveying screw (the rotary shaft part 30*a*) through the first gear train at one axial end side and is transmitted to the rotary brush through the gear mounted at the other axial end of the agitation conveying screw 30 (the rotary shaft part 30*a*) and a second gear train (both not shown).

Next, conveyance of the developer will be described. The toner supplied from the toner container 15 is mixed with the carrier in the agitation conveying chamber 24 and supply conveying chamber 25. Then, the developer is agitated by the agitation conveying screw 30 and supply conveying screw 31 and conveyed in the axial direction to circulate between the agitation conveying chamber 24 and supply conveying chamber 25 through developer passages (not shown) formed at both end parts of the partition wall 23.

The developer charged by circulating while being agitated is conveyed to the magnetic roller 32 by the supply conveying screw 31 and forms a magnetic brush (not shown) on the magnetic roller 32. A layer thickness of the magnetic brush on the magnetic roller 32 is regulated by the ear-breaking blade 34. After that, the magnetic brush is conveyed to the part where the magnetic roller 32 faces to the developing roller 33 and a toner thin layer is formed on the developing roller 33 by a potential difference ΔV between Vmag(DC) applied to the magnetic roller 32 and Vslv(DC) applied to the developing roller 33 and a magnetic field. That is, the magnetic roller 32 supplies the toner from the carrying developer to the developing roller 33.

It is noted that the layer thickness of the toner thin layer on the developing roller 33 varies due to resistance of the developer, a difference of rotational speeds of the magnetic roller 32 and the developing roller 33, and others, and moreover, can be controlled by the potential difference ΔV. The toner thin layer is thickened by increasing the potential difference ΔV and is thinned by reducing the potential difference ΔV. An adequate range of the potential difference ΔV during development is around 100 V to 350 V in general.

The toner thin layer formed on the developing roller 33 is conveyed to the facing area S where the developing roller 33 faces to the photosensitive drum 9 by the rotation of the developing roller 33. Because Vslv(DC) and Vslv(AC) are applied to the developing roller 33, the toner flies due to a potential difference between the developing roller 33 and photosensitive drum 9, and a toner image on the photosensitive drum 9 is developed.

The remained toner without being used in the development is conveyed to the facing part where the developing roller 33 faces to the magnetic roller 32 and is collected by the magnetic brush on the magnetic roller 32. Subsequently, the magnetic brush is peeled from the magnetic roller 32 by a homopolar part of the magnetic pole member 32*b*, and then, falls into the supply conveying chamber 25.

After that, a predetermined amount of toner is replenished from the toner replenishing port 26 on the basis of a detected result of the toner density sensor, and a developer uniformly charged with suitable toner density is made again while circulating in the supply conveying chamber 25 and agitation conveying chamber 24.

Figure 4:
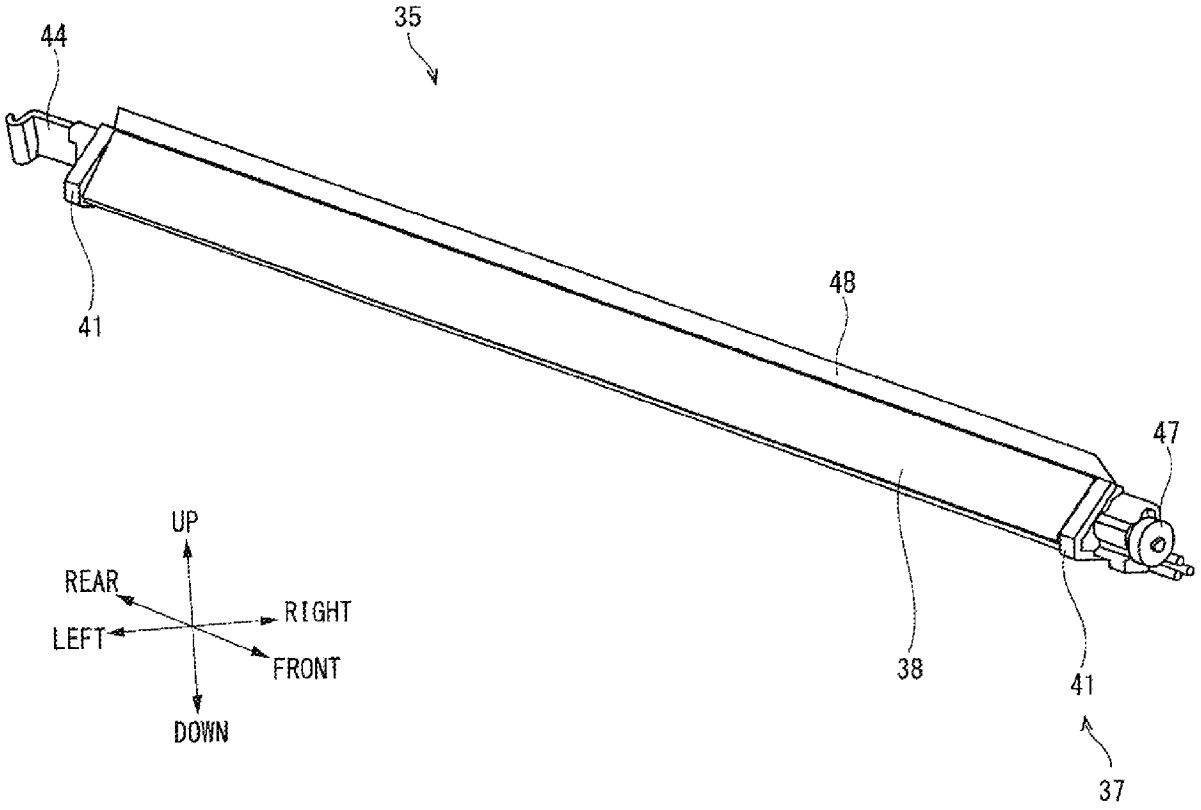
FIG. 4 is a perspective view showing a toner receiving mechanism part in a condition in which a sheet member is stretched in the development device of the embodiment of the present disclosure.
Figure 5:
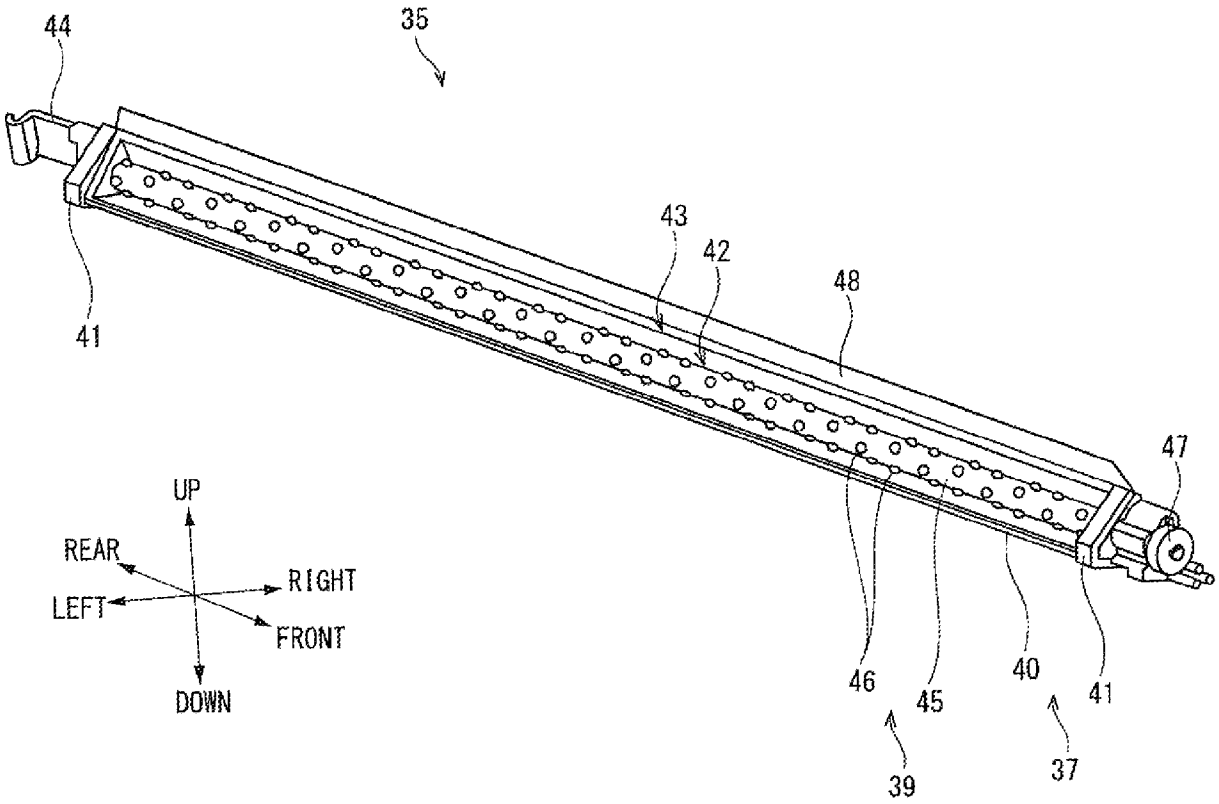
FIG. 5 is a perspective view showing the toner receiving mechanism part in a condition in which the sheet member is removed in the development device of the embodiment of the present disclosure.
Figure 6:
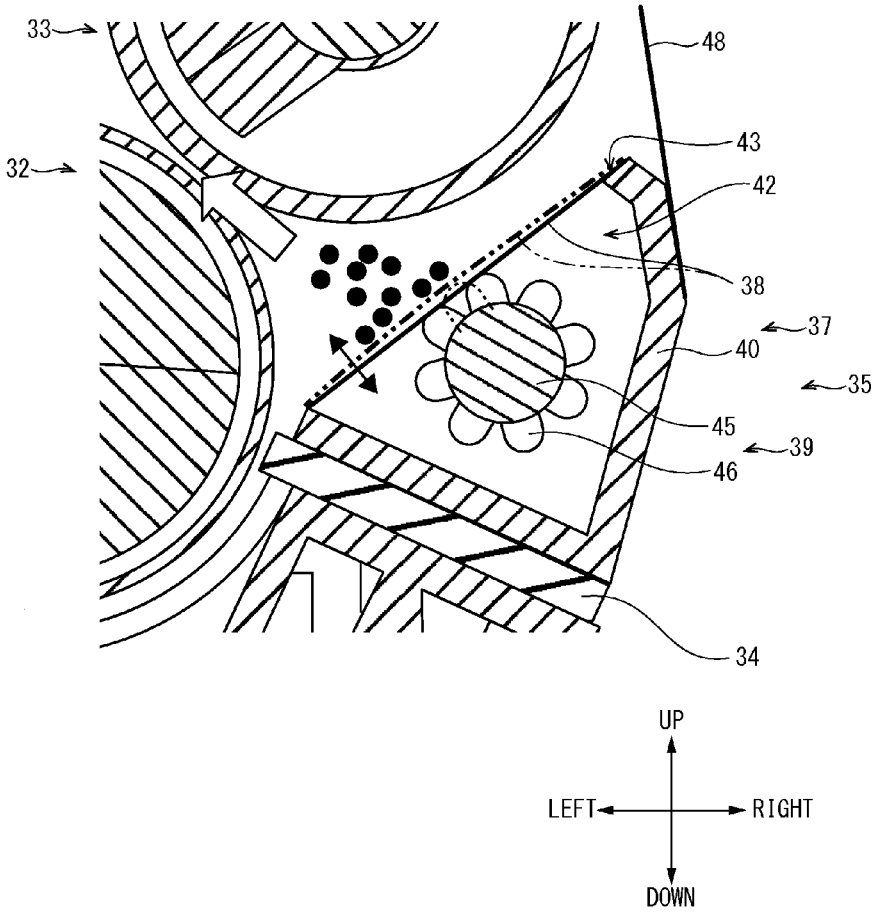
FIG. 6 is a sectional view illustrating an action of the toner receiving mechanism part of the development device of the embodiment of the present disclosure.

Next, the toner receiving mechanism part 35 will be described in detail with reference to FIGS. 3 through 6. FIG. 4 is a perspective view showing the toner receiving mechanism part 35 in a condition in which the sheet member is stretched in the development device 11 of the present embodiment, FIG. 5 is a perspective view showing the toner receiving mechanism part 35 in a condition in which the sheet member 38 is removed, and FIG. 6 is a section view illustrating an action of the toner receiving mechanism part 35 of the development device 11 of the present embodiment.

The toner receiving mechanism part 35 includes a support member 37 provided in the casing 21 and configured to hold the ear-breaking blade 34, a sheet member 38 held by the support member 37 to receive the toner falling from the developing roller 33, and a vibration applying device 39 that gives vibration to the sheet member 38.

The support member 37 includes a support main body part 40 extending along a longitudinal direction (the axial direction of the magnetic roller 32 and others) of the casing 21, and a pair of main body holding parts 41 connected with both longitudinal ends of the support main body part 40.

As shown in FIG. 3, the support main body part 40 is formed into a substantially triangular shape in section viewed from the axial direction. The support main body part 40 is disposed in a condition in which a lower surface is in close contact with an upper surface of the ear-breaking blade 34 so as to become equal plane to an outer surface of the casing 21. That is, the ear-breaking blade 34 is put between the support main body part 40 (the support member 37) and casing 21.

The support main body part 40 is also provided with a concave part 42 concaved from a surface facing to the developing roller 33 in an inside of the casing 21 to an outside of the casing 21. That is, the support main body part 40 is formed into a box-like shape so that a surface facing to the developing roller 33 is opened. This opened surface 43 (the surface facing to the developing roller 33) of the concave part 42 is formed aslant in the upper right direction from the leading edge part of the ear-breaking blade 34 when viewed from the axial direction.

As shown in FIGS. 4 and 5, each main body holding part 41 is formed into a substantially triangular shape whose section viewed from the axial direction is slightly larger than that of the support main body part 40. The main body holding part 41 of the one axial end (a rear end in FIG. 4) is provided with a hook 44 that extends backward and that engages with an engage part (not shown) of the casing 21 in mounting the toner receiving mechanism part 35 to the casing 21.

The sheet member 38 is formed into a thin and long rectangular shape along the magnetic roller 32 and developing roller 33 by a thin film-like, flexible and stretchable material. That is, the sheet member 38 is formed into a size permitting to cover the concave part 42 of the support main body part 40. The sheet member 38 is composed of a material (e.g. urethane, fluororesin or the like) to which the toner hardly adheres in order to suppress adhesion of the toner. It is noted that, for example, a (fluorine-based) coating may be implemented on a surface of the sheet member 38 made of synthetic rubber.

Both ends in the longitudinal direction (the axial direction of the magnetic roller 32 and others) of the sheet member 38 are fixed to the both longitudinal ends of the support main body part 40 in a condition in which the sheet member 38 is tensioned as a whole. That is, the sheet member 38 is stretched so as to close the open surface 43 of the concave part 42.

As shown in FIGS. 5 and 6, the vibration applying device 39 is composed of a vibration roller 45 extending in the longitudinal direction (the axial direction of the magnetic roller 32 and others) of the casing 21 and a plurality of projections 46 provided so as to project on a circumferential surface of the vibration roller 45.

The vibration roller 45 is disposed within the concave part 42 and is rotatably pivoted longitudinally by the pair of main body holding parts 41. Another axial end of the vibration roller 45 (a front end part in FIG. 5) penetrates through the main body holding part 41 and extends, and a gear 47 is axially attached to this extended end. The gear 47 is connected to the driving unit 36 (see FIG. 2) through the second gear train described above, and the vibration roller 45 rotates in conjunction with the screws 30 and 31 and the rollers 32 and 33, respectively, as the driving unit 36 is rotationally driven. It is noted that the rotary brush described above also rotates together with the vibration roller 45.

Each projection 46 is formed into a substantially cylindrical shape whose leading edge (free end) is formed into a semi-spherical shape. The respective projections 46 adjacent with each other in the longitudinal direction (the axial direction) are disposed such that their positions are shifted in a circumferential direction, and the plurality of projections 46 are disposed in zigzag around a whole circumferential surface of the vibration roller 45 as a whole.

It is noted that a diameter of the vibration roller 45 and a projection length of the projection 46 are set such that they do not contact with an inner surface of the concave part 42 of the support main body part 40 and such that the projection 46 pushes up the sheet member 38 when the projection 46 abuts the sheet member 38 and this push is released when the projection 46 separates from the sheet member 38.

A film-like seal member 48 is provided at an upper end of the support member 37 so as to extend out to the opening 22 side of the casing 21 (see FIG. 3). The seal member 48 extends in the longitudinal direction of the support member 37 such that a leading edge part is in contact with the surface of the photosensitive drum 9. The seal member 48 has a function of blocking the toner within the casing 21 from leaking to the outside.

Next, an action of the toner receiving mechanism part 35 that prevents the toner from accumulating around the ear-breaking blade 34 will be described with reference to FIG. 6. The description will be made here by mainly notifying one any projection 46 in order to simplify the description.

When the driving unit 36 starts to be rotationally driven, the vibration roller 45 rotates around its axis. It is noted that the rotational direction may be optionally determined. As the vibration roller 45 rotates, the projection 46 reaches a position where the projection 46 comes into contact with the sheet member 38 from the inside of the concave part 42. As the rotation of the vibration roller 45 advances, the projection 46 pushes up the sheet member 38 above the open surface 43 (or more accurately in a normal direction of the open surface 43) as indicated by a two-dot chain line in FIG. 6 while in sliding contact with a lower surface of the sheet member 38 (the inside of the concave part 42).

As the rotation of the vibration roller 45 advances further, the projection 46 separates gradually from the lower surface of the sheet member 38 and the push of the sheet member 38 is gradually released. As indicated by a solid chain line in FIG. 6, the sheet member 38 comes down to the substantially same level with the open surface 43 by its own stretchability. It is noted that at this time, another push of the sheet member 38 at a position shifted in the axial direction is started by another projection 46 axially adjacent to the aforementioned projection 46.

The push and its release of the sheet member 38 described above are sequentially repeated, and accordingly, the sheet member 38 vibrates in the normal direction of the open surface 43. The toner accumulated on the sheet member 38 is shaken off by this vibration, so it is possible to prevent the toner from accumulating on the sheet member 38.

In addition, by this vibration, the toner on the sheet member 38 is bounced up and separated from the toner receiving mechanism part 35 and is sent a space above the magnetic roller 32 by riding an airflow generated by the rotation of the magnetic roller 32 and developing roller (see blank arrows in FIGS. 3 and 6). Then, the toner conveyed to the space above the magnetic roller 32 falls down to the supply conveying chamber 25. Thereby, it is possible to adequately prevent the toner floating within the casing 21 from leaking out of the opening 22 (the facing area S) of the casing 21 to the printer main body 2.

According to the development device 11 of the present embodiment described above, by applying the vibration to the flexible and stretchable sheet member 38 by the vibration applying device 39, the stretched sheet member 38 vibrates substantially uniformly by its own stretchability (elasticity). This enables to shake off the accumulated toner efficiently across the whole sheet member 38, so it is possible to prevent the toner from being kept in an accumulated condition. Accordingly, it is possible to effectively suppress internal contamination of the printer main body 2 caused by the floating toner leaked out of the opening 22 facing to the photosensitive drum 9, image defects caused by the fall of the toner when the accumulated toner coagulates (blocking) and adheres the developing roller 33, and other disadvantages without depending on linear velocity of the magnetic roller 32 and developing roller 33.

According to the development device 11 of the present embodiment, because the sheet member 38 is fixed to the both longitudinal ends of the support main body part 40, the sheet member 38 vibrates largely in the normal direction of the open surface 43. That is, it is possible to increase amplitude of the vibration. Thereby, it is possible to efficiently shake off the toner on the sheet member 38 and to prevent the accumulation of the toner effectively.

According to the development device 11 of the present embodiment, the ear-breaking blade 34 is held by the support member 37 together with the sheet member 38. The vibration applying device 39 (the vibration roller 45) is also disposed within the concave part 42 concaved in the support member 37 (the support main body part 40) so that the vibration is directly applied to the sheet member 38 stretched to cover the concave part 42. Thereby, it is possible to simplify the structure of the development device and to utilize a dead space effectively, and therefore, the development device can be downsized.

According to the development device 11 of the present embodiment, the driving unit 36 rotating the screws 30 and 31 and the rollers 32 and 33 also rotates the vibration roller 45. That is, the driving unit 36 is utilized for the both rotations of the screws 30 and 31 and the rollers 32 and 33, respectively, and of the vibration roller 45. As the vibration roller 45 is rotated by this commonized driving unit 36, the respective projections 46 come into contact with and push up the sheet member 38 and the pushes are released when the contact is released. Accordingly, because no driving source dedicated for the vibration roller 45 needs to be provided and the vibration can be applied to the sheet member 38 just by rotating the vibration roller 45, it is possible to simplify the structure of the development device.

It is noted that although the rotation of the agitation conveying screw 30 is transmitted to the second gear train in the description of the development device 11 described above, the present disclosure is not limited to that, and, for example, the rotation may be transmitted by the supply conveying screw 31 or the respective rollers 32 and 33. Alternatively, the second gear train may be omitted and the rotary brush and the gear 47 of the vibration roller 45 may be provided at the one axial end.

It is also noted that the shape of the projection 46 is not limited to the substantially cylindrical shape and may be formed into any shape. The number of the projections 46 may be also any number as long as at least one projection is projectingly provided. The developer is not also limited to the two-component developer described above and may be any developer containing toner that develops an electrostatic latent image on the photosensitive drum 9 as a toner image.

Figure 7:
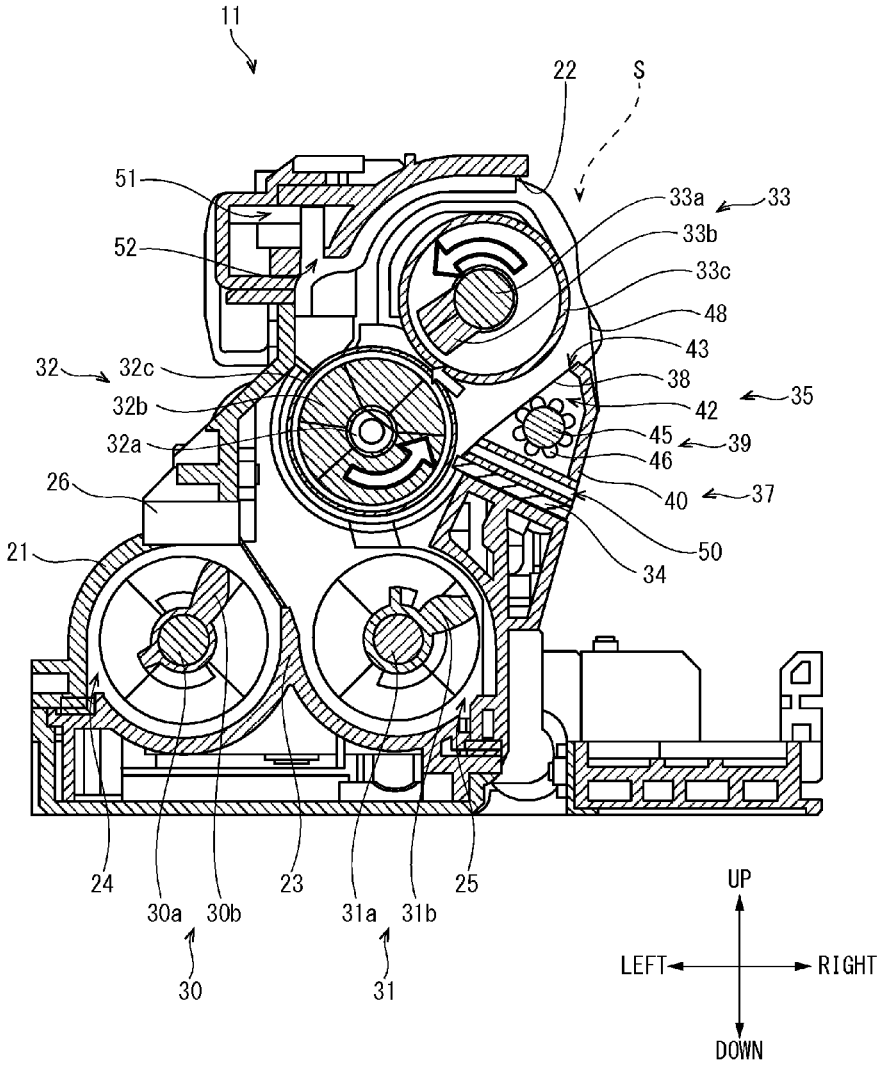
FIG. 7 is a sectional view schematically showing an internal structure of the development device according to a modified example of the embodiment of the present disclosure.

As shown in FIG. 7, the development device may be also configured such that an air inlet hole 50 that communicating the inside and outside of the casing 21 with each other is formed in the support main body part 40 and an air outlet hole 52 communicating with a duct 51 if formed at an upper end part of the casing 21.

In this case, in a lower part of the support main body part 40, the plurality of slit-like air inlet holes are formed along the longitudinal direction (a direction vertical to the sheet surface of FIG. 7).

In the upper part of the casing 21, the air outlet hole 52 communicating with the duct 51 is formed. The duct 51 is connected with an exhaust fan (not shown) provided in the printer main body 2, and a filter (not shown) is disposed in a channel (not shown) of the exhaust fan and the duct 51.

As described above, pressure in the vicinity of the ear-breaking blade 34 is negative due to the airflow (see the blank arrow in FIG. 7) generated by the rotations of the magnetic roller 32 and developing roller 33. Due to that, air flows into the inside of the casing 21 from the outside through the air inlet hole 50 (an inflow air). This inflow air converges with the airflow described above. Thereby, even if the toner bounced up by the vibration of the sheet member 38 falls around the ear-breaking blade 34, the toner may ride on the abovementioned airflow and be sent to the space above the magnetic roller 32. Then, this upward airflow is discharged out of the air outlet hole 52 through the duct 51. That is, a path of the airflow from the air inlet hole 50 to the duct 51 is formed within the casing 21. Thereby, the toner eliminated from and bounced up by the sheet member 38 can be collected by the filter described above.

While the preferable embodiment and its modified example of the development device 11 and the color printer (the image forming apparatus) of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment.

What is claimed is:

1. A development device, comprising:

a sheet member disposed between a developer carrier and a blade to receive a developer falling from the developer carrier toward the blade, wherein the developer carrier is disposed so as to face to an image carrier on which an electrostatic latent image is formed and configured to supply the developer to the image carrier in a facing area to the image carrier, and the blade is configured to regulate an amount of the developer carried on the developer carrier;

a support member holding the sheet member; and a vibration applying device configured to apply vibration to the sheet member;

wherein the sheet member is stretchable and flexible and is formed into a thin and long shape along the developer carrier, and both longitudinal end parts thereof are fixed to the support member in a condition in which the sheet member is tensioned.

2. The development device according to claim 1, further comprising a casing that houses the developer carrier and the blade;

wherein the blade is held by being put between the support member and casing;

the support member is provided with a concave part which is concaved from the developer carrier side and in which the vibration applying device is disposed; and the sheet member is stretched so as to cover the concave part.

3. The development device according to claim 2, wherein the vibration applying device includes:

a roller extending in an axial direction;

a projection provided so as to project on a circumferential surface of the roller to push up the sheet member from the concave part side; and a driving unit that rotationally drives the developer carrier and roller.

4. The development device according to claim 2, further comprising an agitation member disposed in a conveying chamber formed at a lower part of the casing and configured to agitate and convey the developer containing a toner;

wherein the developer carrier is composed of a magnetic roller that carries the developer supplied from the agitation member, and a developing roller disposed so as to face to the magnetic roller and image carrier, respectively, and configured to carry the toner within the developer conveyed by the rotation of the magnetic roller and to supply the carrying toner to the image carrier; and the toner shaken off from the sheet member by vibration applied from the vibration applying device is conveyed to the conveying chamber by passing through between the magnetic roller and development roller.

5. The development device according to claim 2, wherein an air inlet hole configured to communicate an inside and an outside of the casing with each other is formed in a lower part of the support member and an air outlet hole configured to communicate with a duct is formed in an upper end part of the casing.

6. An image forming apparatus comprising:

a development device, wherein the development device includes:

a sheet member disposed between a developer carrier and a blade to receive a developer falling from the developer carrier toward the blade, wherein the developer carrier is disposed so as to face to an image carrier on which an electrostatic latent image is formed and configured to supply the developer to the image carrier in a facing area to the image carrier, and the blade is configured to regulate an amount of the developer carried on the developer carrier;

a support member holding the sheet member; and a vibration applying device configured to apply vibration to the sheet member;

wherein the sheet member is stretchable and flexible and is formed into a thin and long shape along the developer carrier, and both longitudinal end parts thereof are fixed to the support member in a condition in which the sheet member is tensioned.

7. The image forming apparatus according to claim 6, further comprising a casing that houses the developer carrier and the blade;

wherein the blade is held by being put between the support member and casing;

the support member is provided with a concave part which is concaved from the developer carrier side and in which the vibration applying device is disposed; and the sheet member is stretched so as to cover the concave part.

8. The image forming apparatus according to claim 7, wherein the vibration applying device includes:

a roller extending in an axial direction;

a projection provided so as to project on a circumferential surface of the roller to push up the sheet member from the concave part side; and a driving unit that rotationally drives the developer carrier and the roller.

9. The image forming apparatus according to claim 7, further comprising an agitation member disposed in a conveying chamber formed at a lower part of the casing and configured to agitate and convey the developer containing toner;

wherein the developer carrier is composed of a magnetic roller that carries the developer supplied from the agitation member, and a developing roller disposed so as to face to the magnetic roller and image carrier, respectively, and configured to carry the toner within the developer conveyed by the rotation of the magnetic roller and to supply the carrying toner to the image carrier; and the toner shaken off from the sheet member by vibration applied from the vibration applying device is conveyed to the conveying chamber by passing through between the magnetic roller and development roller.

10. The image forming apparatus according to claim 7, wherein an air inlet hole configured to communicate the inside and an outside of the casing with each other is formed in a lower part of the support member and an air outlet hole configured to communicate with a duct is formed in an upper end part of the casing.

* * * * *